United States Patent [19]

Falconnet

[11] Patent Number: 4,884,515

[45] Date of Patent: Dec. 5, 1989

[54] FURNANCE HEARTH ASHBOX WITH EXTRACTOR CHAMBER THAT IS EASY TO UNJAM

[75] Inventor: Claude Falconnet, Conflans-Saint-Honorine, France

[73] Assignee: T.I.R.U. - Traitement Industriel Des Residus Urbains, Paris, France

[21] Appl. No.: 301,356

[22] Filed: Jan. 25, 1989

[30] Foreign Application Priority Data

Jan. 29, 1988 [FR] France ..... 88 01054

[51] Int. Cl.[4] ..... F23D 1/02

[52] U.S. Cl. ..... 110/171; 110/168; 110/169; 110/170

[58] Field of Search ..... 110/165 R, 170, 171, 110/259, 168, 169; 126/242, 243

[56] References Cited

U.S. PATENT DOCUMENTS 4,048,928 9/1977 Martin ..... 110/165 R
4,520,738 6/1985 Takehara ..... 110/171
4,625,660 12/1986 Brungger et al. ..... 110/171 X

FOREIGN PATENT DOCUMENTS 1477877 4/1967 France .
2323102 4/1977 France .
275496 8/1927 United Kingdom .

*Primary Examiner*—Edward G. Favors
*Attorney, Agent, or Firm*—Charles E. Brown; Charles A. Brown

[57] ABSTRACT

An ashbox for the hearth of a furnace adapted to burn solid fuel, descending along in inclined grate as it burns. The ashbox comprises an extractor chamber having a concave bottom which is part-cylindrical with horizontal generatrices. This chamber is normally filled with water to a level below the upper edge of the chamber. A vertical clinker well terminates at a lower lip below the upper edge of the chamber and is immersed in the water in the chamber. A scraper blade is reciprocated perpendicularly to the generatrices of the concave bottom. An inclined wall merges at its lower end with the concave bottom of the chamber and has an overflow at its upper end above the normal level of the water in the chamber. The arrangement is such that the scraper blade pushes ash up over the overflow lip. The extractor chamber is in two parts and can be opened by relative displacement of these parts to provide vertical access to the ash well. One part of the chamber is a tilting part comprising the concave bottom and the scraper blade.

12 Claims, 4 Drawing Sheets

FURNANCE HEARTH ASHBOX WITH EXTRACTOR CHAMBER THAT IS EASY TO UNJAM

BACKGROUND OF THE INVENTION

1. Field of the invention

The invention concerns an ashbox for the hearth of a furnace adapted to burn solid fuel, especially urban waste, discharged onto an upper end of an inclined grate and descending along the grate as it burns to a lower end of the grate, the ashbox comprising an extractor chamber having an upper edge and a concave bottom which is part-cylindrical with horizontal generatrices, the chamber being adapted to be filled with water to a normal level below that of the upper edge, a vertical clinker well under the lower end of the grate, terminating at a lower lip below the upper edge of the chamber and adapted to be immersed in the water in the chamber when filled to the normal level, a scraper blade adapted to bear on the concave bottom of the chamber along a generatrix thereof, means for reciprocating the scraper blade perpendicularly to the generatrices of the concave bottom of the chamber, an inclined wall merging at its lower end with the concave bottom of the chamber along a generatrix thereof, and an overflow lip at the upper end of the inclined wall above the normal level of the water in the chamber, the arrangement being such that reciprocation of the scraper blade pushes ash up the inclined wall and over the overflow lip, into recovery means.

2. Description of the prior art

This conventional arrangement makes it possible to remove the ash in a virtually continuous way without disturbing the conditions under which the fuel is burned, the water seal in the chamber making it possible to isolate the hearth from the external atmosphere so that the burning gases are not deviated from their circulation in the furnace towards the fumes offtake flues if the hearth is at a pressure higher than that of the external atmosphere and so that the admission of combustion-supporting air under the grate is not bypassed by air entering through the ashbox if the hearth is at a pressure lower than that of the external atmosphere.

On falling into the water the hot ash is cooled and in particular incandescent clinker is extinguished and possibly broken up as a result of thermal shock.

The term ash is used generically for any material reaching the downstream end of the grate whether this comprises mineral residues, unburnt materials, incombustible items such as metal parts and, more particularly, clinker or partially vitrified ash aggregates.

Sometimes (and frequently in the case of urban waste) large incombustible objects may be mixed with the solid fuel discharged onto the grate; urban waste commonly contains bicycle frames and component parts of cookers or other domestic appliances; this kind of waste also contains tree stumps where soil trapped between the roots protects the latter from complete combustion so that they form a solid lump.

These foreign bodies may become jammed in the chamber and in any event are not ideally suited to being pushed up the inclined wall; the result is a jam in the chamber.

To clear this is necessary to shut down the hearth, drain the water out of the chamber and then extract the cause of the jam either through inspection hatches in the chamber or along the inclined wall, cutting up the jammed object in situ if necessary.

These operations are difficult, extremely laborious and likely to require the furnace hearth to be shut down for relatively, long periods.

The document FR-A-1 477 877 proposes to provide the lip of the clinker well with a pendulum wall having a counterweight at its lower end so that any large foreign body pushed onto it by the scraper blade can free itself by raising the pendulum wall towards the inclined wall.

This arrangement makes it possible to avoid some jams; on the other hand, there is the risk that the seal provided by the water seal may be inadequate.

What is more, this arrangement cannot prevent jams if the foreign body is jammed between one wall of the chamber and the scraper blade or if the foreign body cannot be removed via the inclined wall. In these cases the previously mentioned problems arise.

The document FR-A-1 477 877 proposes to accelerate the return of the mobile wall by spring means or the like to prevent too much combustion gas and hot ash escaping while the foreign body is freed; this spring increases the risk of jamming, however.

An object of the invention is to enable effective clearance of jams whatever the shape of the foreign body causing the jam with minimum intervention time and minimum disturbance to the operating conditions of the furnace hearth.

SUMMARY OF THE INVENTION

The invention consists in an ashbox for the hearth of a furnace adapted to burn solid fuel, especially urban waste, discharged onto an upper end of an inclined grate and descending along the grate as it burns to a lower end of the grate, the ashbox comprising an extractor chamber having an upper edge and a concave bottom which is part-cylindrical with horizontal generatrices, the chamber being adapted to be filled with water to a normal level below that of the upper edge, a vertical clinker well under the lower end of the grate, terminating at a lower lip below the upper edge of the chamber and adapted to be immersed in the water in the chamber when filled to the normal level, a scraper blade adapted to bear on the concave bottom of the chamber along a generatrix thereof, means for reciprocating the scraper blade perpendicularly to the generatrices of the concave bottom of the chamber, an inclined wall merging at its lower end with the concave bottom of the chamber along a generatrix thereof, and an overflow lip at the upper end of the inclined wall above the normal level of the water in the chamber, the arrangement being such that reciprocation of the scraper blade pushes ash up the inclined wall and over the overflow lip, into recovery means, in which ashbox the extractor chamber is in two parts and can be opened by relative displacement thereof to provide vertical access to the ash well, one part of the chamber being a fixed part comprising the inclined wall and the upper edge of the chamber and the other part being a tilting part comprising the concave bottom and the scraper blade and adapted to pivot relative to the fixed part about an axis parallel to the generatrices of the concave bottom between an open position and a closed position in which it is sealed to the fixed part on a sealing surface.

When a jam occurs the hearth is damped down in such a way that the pressure in the hearth is slightly below that of the external atmosphere and discharge of ash from the grate is substantially halted. Most of the water in the chamber is drained off and the chamber is then opened above an appropriate receptacle; the wet ash and the foreign body which has caused the jam are generally freed and fall into the receptacle, since the foreign body is offered a substantially vertical passage at least as large as the passage through which it has passed in the clinker well. If an oblong foreign body is still jammed, opening the chamber provides easy access to work and clear the jam.

The sealing surface is preferably a dihedron comprising two half-planes intersecting at an edge parallel to the generatrices of the concave bottom, substantially coincident with the normal level of the water in the chamber and on the side of the well nearer the inclined wall, the dihedron being convex in the tilting part and concave in the fixed part.

This arrangement makes it possible to increase the surface area of the lateral walls of the tilting part of the chamber in which there are provided openable inspection hatches to enable work to be carried out inside the chamber. In this way the surface area of these hatches may be increased.

The preferred arrangement of the dihedral sealing surface is that in which one of the half-planes of the dihedron is directed downwardly and substantially perpendicularly to the inclined wall so as to pass substantially through the generatrix at which the concave bottom merges with this wall and the other half-plane rises from the intersection edge to the upper edge of the chamber which it intersects on the side of the well farthest from the inclined wall.

The fixed and tilting parts of the chamber may be juxtaposed through flanges extending outwardly in the half-planes of the dihedron with a gasket between them. Locking means are associated with the flanges for clamping the gasket. The locking means are advantageously operated by hydraulic rams that can be remote-controlled.

In one preferred embodiment of the invention the pivot axis of the tilting part of the chamber is situated above the upper edge of the chamber on the side of the clinker well farthest from the inclined wall. For it to be possible to open the chamber there must be no point on the sealing dihedron on the tilting part whose trajectory passes through the sealing dihedron on the fixed part. The aforementioned position of the sealing dihedron is found to be the most favorable.

In a preferred embodiment the scraper blade is fixed to the end of pusher arms coupled to cranks keyed to a scraper shaft disposed above the level of the water in the chamber and parallel to the generatrices of the concave bottom, on the side of the clinker well farthest from the inclined wall. The scraper shaft is rotated to-and-fro by at least one hydraulic ram disposed substantially horizontally outside the chamber between an articulation to the fixed part of the chamber and a crank pin at the end of a control crank keyed to the scraper shaft with an offset relative to the cranks to which the pusher arms are coupled such that when the ram is retracted the scraper blade is farthest from the inclined wall. The ram therefore expands to push the ash onto the inclined wall with the hydraulic pressure applied to the side of the ram piston which has the maximum effective surface area, that is the side opposite the ram rod.

In conjunction with the position of the pivot axis of the tilting part above the upper edge of the chamber, as defined above, this arrangement makes it possible to incorporate the important feature now to be described:

As the crank pin on the control crank has a trajectory which passes between the scraper shaft axis and the pivot axis of the tilting part of the chamber locking means disposed between the scraper shaft and the tilting part of the chamber can, in their active state, prevent rotation of the scraper shaft with the scraper blade farthest from the generatrix of the concave bottom at which the latter merges with the inclined wall.

Normally, the locking means are inactive and expansion of the ram pushes the ash onto the inclined wall. However, if a jam occurs the ram is retracted to return the scraper blade to the position farthest from where the concave bottom merges with the inclined wall and the locking means are then activated. The water is drained off from the chamber and the tilting part is unlocked from the fixed part of the chamber. Expansion of the ram applied to the (virtual) lever arm extending from the pivot axis of the tilting part to the crank pin on the control crank then opens the chamber.

In a preferred embodiment the locking means comprise a radial finger on the scraper shaft outside the chamber, an abutment on the tilting part against which the radial finger bears when the scraper blade is farthest from the generatrix at which the concave bottom merges with the inclined wall and a ram-actuated plunger aligned directionally with the abutment which in an extended position corresponding to the active state of the locking means presses the finger onto the abutment and in a retracted position is away from the path of movement of the finger. It is therefore possible to control remotely and without wasting time switching of the ram function from operating the scraper blade to opening the chamber.

In a preferred embodiment the grate comprises at its downstream end a flap tilting about a shaft transverse to the grate; the thickness of the layer of combustible material on the downstream end of the grate can be adjusted by raising this flap to a greater or lesser degree relative to the plane of the grate. By raising it perpendicular to the plane of the grate and reducing the rate of combustion and the rate of displacement of the movable bars of the grate ash may be stopped from falling into the clinker well while a jam is cleared.

The chamber is conventionally equipped with pipes for evacuating water to a drain with overflow holes at the level of the water in the chamber and drain holes in the lower part fitted with associated valves so that the level of the water in the chamber cannot exceed the height just necessary to maintain a water seal and so that the chamber can be drained to clear any jam. In a preferred arrangement these off take pipes are mounted on the tilting part of the chamber and terminate at the lower end in at least one flow nozzle. A fixed trough lies below the flow nozzles when the chamber is closed. It will be understood that the movements of the scraper blade accumulate ash in the fixed part and push it up the inclined wall so that there is virtually no risk of the overflow and drain holes in the tilting part being clogged by the ash.

Secondary characteristics and the advantages of the invention will emerge from the following description given by way of example with reference to the appended drawings.

DESCRIPTION OF THE PREFERRED EMBODIMENT

Figure 1:
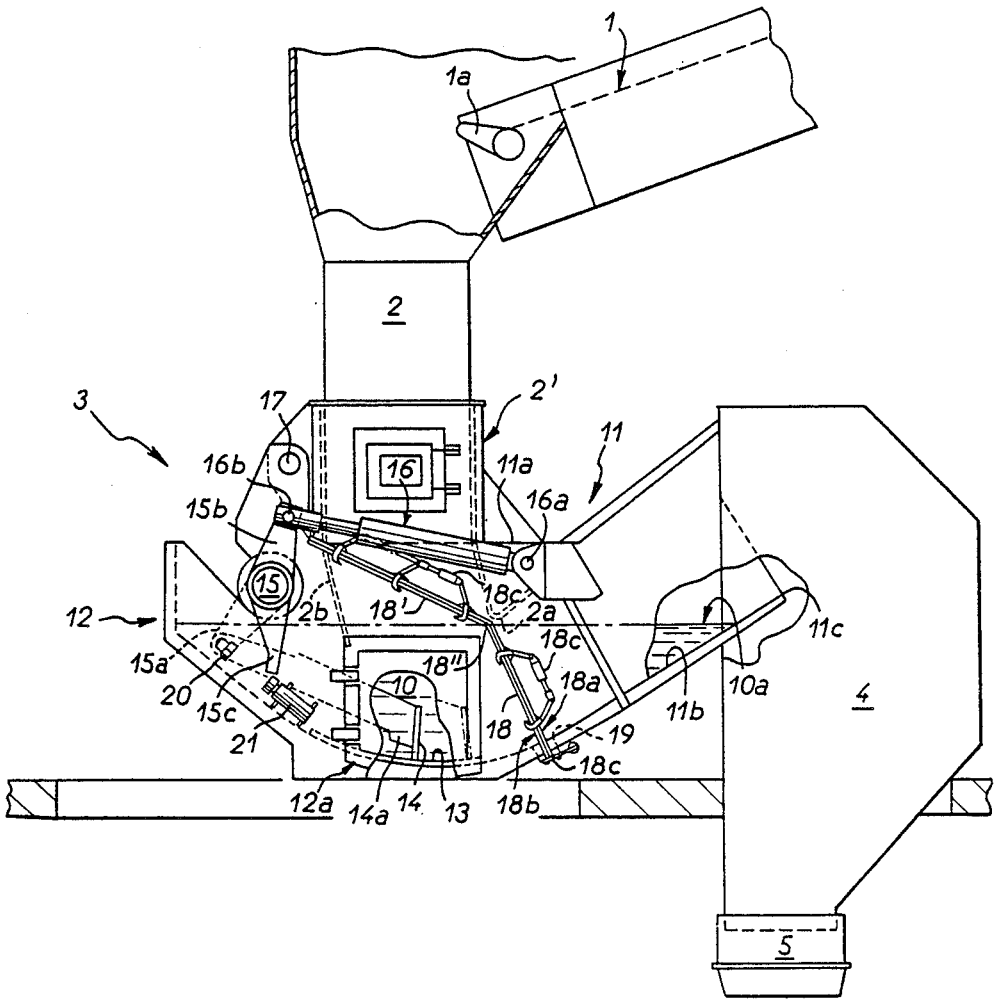
FIG. 1 shows in elevation and partially cut away an ashbox in accordance with the invention in normal operation.

In the selected embodiment shown in FIG. 1, at the downstream end of a combustion grate 1 is a generally vertical clinker well 2. The grate is of the type in which bars made up of laterally juxtaposed elements are alternately fixed and reciprocable longitudinally in a downward succession from an upstream loading end to the downstream end. The grate is supplied from below with combustion-supporting air which passes through the grate by means of holes formed in the bar elements. At the downstream end of the grate 1 is a flap 1*a* movable about an axis transverse to the grate. The flap 1*a* can be inclined relative to the plane of the grate 1 to a greater or lesser degree to adjust the level of ash at the downstream end of the grate and optimize the combustion of the last combustible portions.

The clinker well 2 has a rectangular cross-section with its larger dimension transverse to the grate and comprises in its upper part hopper-like walls whereby the larger dimension of the well 2 is adapted to the width of the grate 1. The well 2 is connected to an extractor chamber 3 which includes in the upper part a conduit 2′ extending the clinker well 2. The chamber 3 is filled with water up to a level 10*a* which is lower than an upper edge 11*a*. The conduit 2′ is defined parallel to plane of the figure by the vertical lateral walls of the chamber 3 and perpendicularly to the plane of the figure by two downwardly directed partitions. One of these partitions, not referenced as a whole, terminates in a horizontal lip 2*a* at a level lower than the level 10*a* of the water 10 in the chamber 3 and the opposite partition 2*b* descends deeper into the water 10.

The immersion of the lip 2*a* in the water 10 forms a water seal which decouples the pressure in the hearth from atmospheric pressure in order to prevent disturbance to the movement of the combustion gases.

These arrangements are conventional and there is no need for any further description of their construction. It will be noted that the conduit 2′ which in structural terms is part of the chamber 3 may be functionally regarded as an extension in the downward direction of the clinker well 2, whether in terms of guiding clinker towards the bottom of the chamber or of sealing the hearth above the water seal.

In this description the well 2 is therefore regarded from a functional point of view as being extended by the conduit 2′ as far as the lip 2*a* below the level 10*a* of the water in the chamber 3.

The chamber 3 has a concave bottom 13 which is part-cylindrical with the generatrices horizontal and perpendicular to the plane of FIG. 1. The bottom merges at a merging generatrix 19 with an inclined wall 11*b* terminating at an overflow lip 11*c* at a level between the water level 10*a* and the upper edge 11*a* of the chamber 3.

The concave bottom 13 is equipped with a scraper blade 14 which bears on the bottom along a generatrix of the cylinder. The scraper blade is mounted at the end of a thrust arm 14*a* articulated by cranks 15*a* to a scraper shaft 15 parallel to the generatrices of the part-cylindrical bottom 13 above the water 10*a* and on the side of the well 2 which is farther from the inclined wall 11*b*.

Outside the chamber 3 the scraper shaft 15 is fitted with a control crank 15*b*. A substantially horizontal hydraulic ram 16 is disposed between an articulation yoke 16*a* fixed to the chamber 3 and a crank pin 16*b* on the control crank 15*b*. As can be seen in the figure the control crank 15*b* is directed upwards and the cranks 15*a* are directed somewhat downwards. The cranks 15*a* and 15*b* are locked together so that with the ram 16 fully retracted (see FIG. 2) the scraper blade 14 is farthest away from the merging generatrix 19, being moved towards this generatrix by expansion of the ram.

In actual fact there are two rams 16, one on each side of the chamber 3, to avoid the application of torsional forces to the chamber 3.

The overflow lip 11*c* of the inclined wall 11*b* is inside a hopper 4. At the bottom of the hopper are clinker removal means 5, shown here as a skip but which could equally well be a conveyor belt, for example.

The various arrangements as described so far are distinguished from conventional arrangements only in details of construction and operation, as follows:

When the ash and clinker resulting from the combustion of the solid fuel discharged onto the upstream end of the grate 1 reach the downstream end of the grate they are pushed onto the mobile flap 1*a* which is appropriately inclined so that they are tipped over the edge of the flap 1*a* to fall into the clinker well 2, either falling freely or being guided by the hopper-like walls.

As the lower lip 2*a* is below the level 10*a* of the water 10 the pressure in the hearth is independent of the external atmospheric pressure, the water 10 providing a seal. It will be remembered that the pressure in the hearth is determined by an overpressure caused by blowing combustion-supporting through the grate 1 (and possibly secondary air) and the draw-off pressure drop caused by a draw-off fan and the chimney.

The ash and clinker therefore fall into the water 10 which extinguishes any portions that are still incandescent and are deposited on the bottom 13. It goes without saying that the water level 10*a* is held substantially constant to compensate for losses by evaporation due to contact with the hot ash and entrainment with the ash.

Part of the time the scraper blade is idle on the bottom 13 at its farthest remove from the merging generatrix 19, the ram 16 being retracted. From time to time the rod of the ram 16 is gradually extended and this moves the scraper blade 14 over the bottom 13 to push the ash and clinker towards and then along the inclined wall 11*b* from which they are tipped over the lip 11*c* into the hopper 4 to end up in the removal means 5. When the rod of the ram 16 has been fully extended it is retracted and the scraper blade 14 returns to its rest position. It is to be understood that the ash and clinker are pushed along the inclined wall by successive displacements of the scraper blade 14. It is also to be understood that the force on the ash and clinker is obtained by extending the ram 16. The travel of the scraper blade requiring a high force corresponds to the pressurization of the chamber of the ram 16 which does not contain the ram rod, where the effective cross-section of the piston is greatest.

Figure 2:
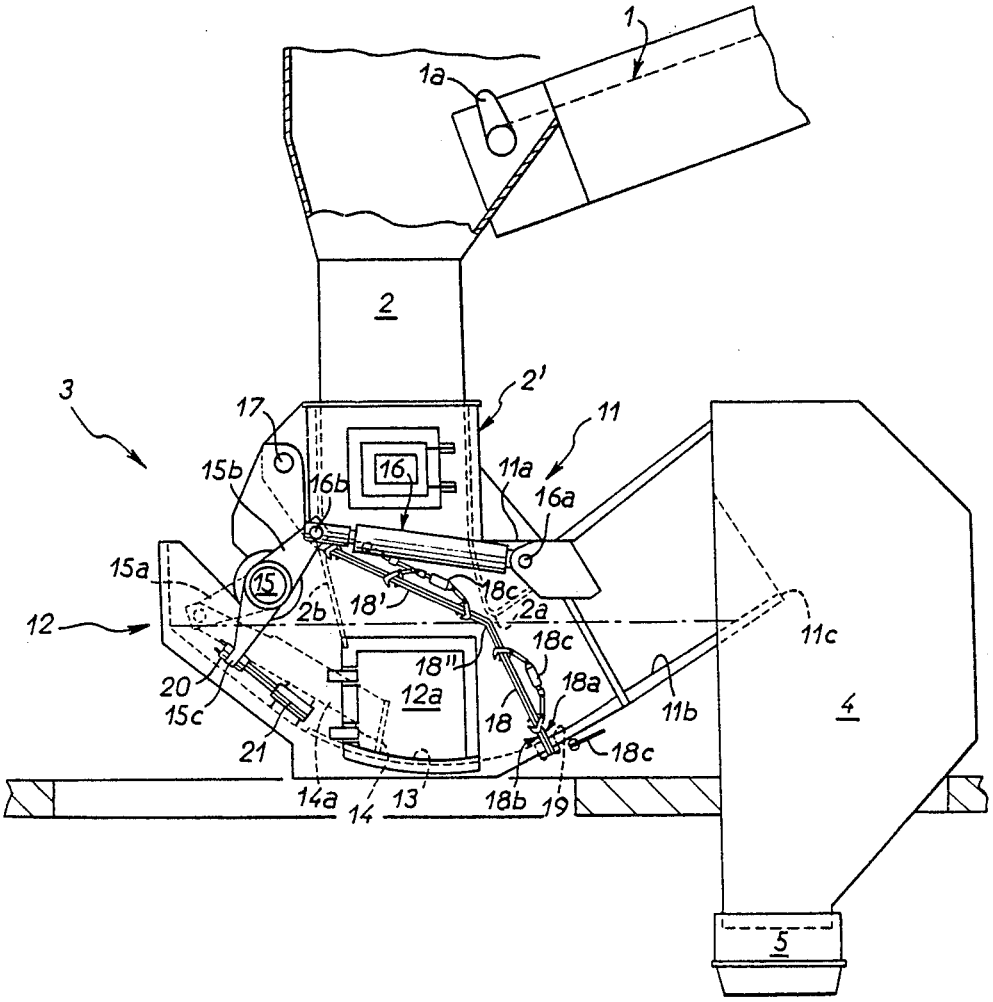
FIG. 2 shows the ashbox from FIG. 1 during preparations to open it.
Figure 3:
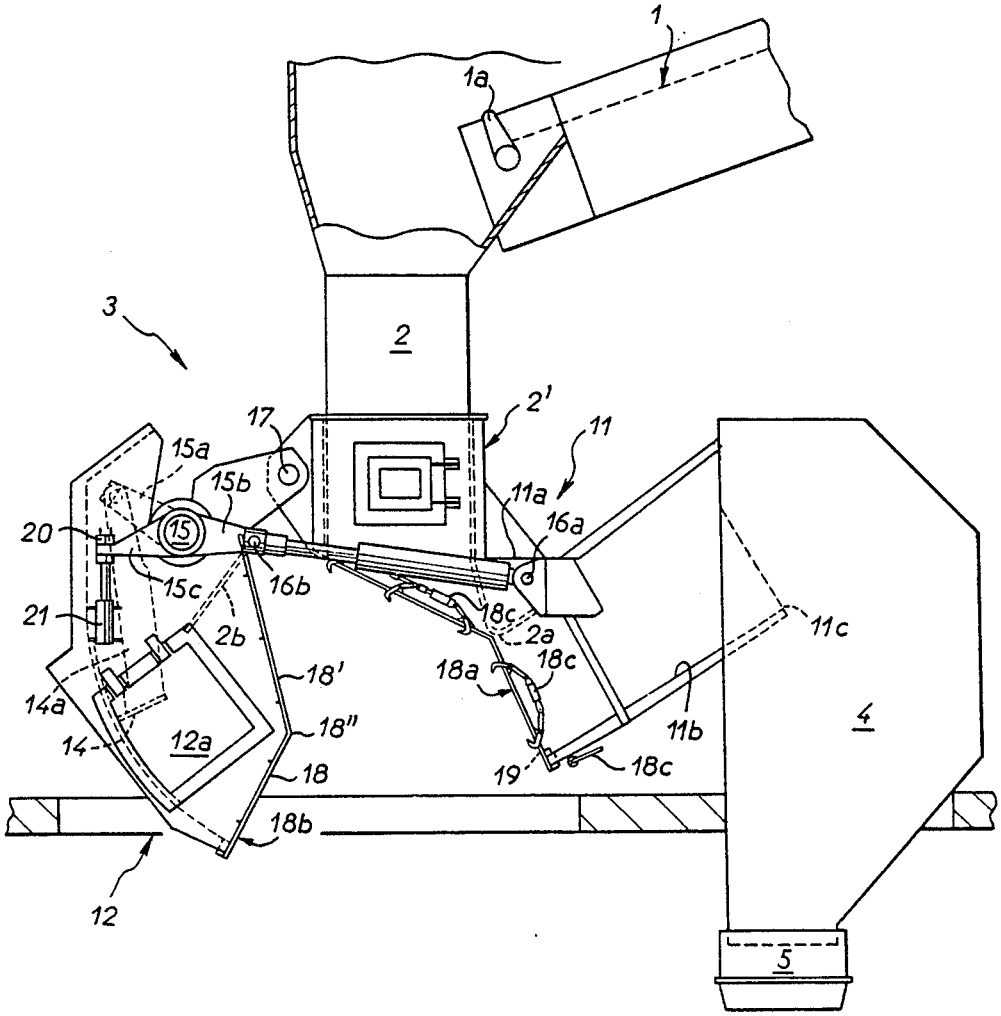
FIG. 3 shows the ashbox from FIGS. 1 and 2 in the open position.

Reference will now be made also to FIGS. 2 and 3.

The key feature of the extractor chamber 3 in accordance with the invention is that it is in two parts, a fixed part 11 and a tilting part 12 which adjoin at a sealing surface with a dihedral shape comprising two half-planes 18 and 18' one on each side of an edge 18" parallel to the generatrices of the bottom and at substantially the same height as the water level 10*a* in the chamber 3.

The dihedron 18, 18' is convex with respect to the tilting part 12 and concave with respect to the fixed part 11. The half-plane 18 runs downwardly from the edge 18" substantially perpendicular to the inclined wall 11*b* to pass substantially through the generatrix where the bottom 13 merges with the inclined wall 11*b*. The half-plane 18' runs upward from the edge 18" until it intersects the plane of the upper edge 11*a* of the chamber 3 on the side of the clinker well 2 farthest from the inclined wall 11*b*. It will be noted that the half-plane 18' extends slantwise across the full width of the well 2.

The fixed part 11 includes the upper edge 11*a* of the chamber 3 and the inclined wall 11*b*. The tilting part includes the concave bottom 13 and contains the scraper blade 14 and the scraper shaft 15: it can pivot about an axis 17 situated above the level of the upper edge 11*a* of the chamber 3 and on the side of the clinker well farthest removed from the inclined wall 11*b*.

Also, the axis 17 is situated approximately above the scraper shaft 15 and sufficiently high for the trajectory of the crank pin 16*b* on the control crank 15*b* to pass between the axis of the scraper shaft 15 and the pivot axis 17 of the tilting part 12.

The fixed part 11 and tilting part 12 comprise, along the sealing dihedron 18, 18', flanges 18*a* , 18*b* extending towards the exterior of the chamber 3 between which is placed a sealing gasket secured to the flange 18*a* of the fixed part. The gasket is clamped under normal circumstances by locking means 18*c* in the form of hooks articulated to the fixed part 11 and which are engaged under projecting members on the tilting part 12 by hydraulic rams.

In the lateral wall of the tilting part 12 is an inspection hatch 12*a* aligned with the clinker well 2 and below the water level 10*a* in the chamber. This inspection hatch is at the corner of the dihedron 18, 18', projecting into the tilting part 12 of the chamber 3.

Substantially in line with the control crank 15*b*, the scraper shaft 15 is equipped with a finger 15*c* which, when the scraper blade 14 is farthest from the merging generatrix 19 between the bottom 13 and the inclined wall 11*b*, bears on a fixed abutment 20 (see FIG. 2 in particular). Opposite the abutment 20 is a ram-actuated plunger 21 aligned with the abutment 20. In its retracted position (FIG. 1) the ram-actuated plunger 21 is away from the path of movement of the finger 15*c*. In its extended position (FIGS. 2 and 3) the ram-actuated plunger 21 locks the finger 15*c* against the abutment 20. Under these conditions extension of the ram 16 is applied to the virtual lever arm formed between the pivot axis 17 of the tilting part 11 and the crank pin 16*b* on the control crank 15*b* fastened to the tilting part 12 by the locking of the finger 15*c* between the abutment 20 and the ram-actuated plunger 21.

When a jam occurs, for example as the result of a large incombustible object loaded onto the grate with the fuel falling into the chamber 3, as manifested in particular by jamming of the scraper blade 14, the procedure employed is as follows:

The hearth is damped down by stopping or at least substantially reducing the draft of air under the grate 1 so that the hearth is at a pressure less than the external atmospheric pressure, reducing the rate of reciprocation of the movable bars of the grate and raising the flap 1*a* to a position substantially perpendicular to the plane of the grate to interrupt the arrival of ash through the clinker well 2.

The water is drained from the extractor chamber 3.

At the same time the scraper blade 14 is returned to its position farthest from the generatrix 19 where the bottom 13 merges with the inclined wall 11*b* and then the ram-actuated plunger 21 is extended to lock the finger 15*c* between the abutment 20 and the plunger 21.

When draining is completed, the rams of the locking means 18*c* are retracted to disengage the projecting members on the mobile part 12 from the hooks articulated to the fixed part 11. FIG. 2 shows the ashbox at this stage in the operation.

The ram 16 may then be gradually extended to open the chamber 3 as shown in FIG. 3. An appropriate receptacle will of course be in place under the chamber to receive the object which caused the jam and the accumulated ash. FIG. 3 shows clearly that the area for removing the jam is substantially larger than the cross-section of the clinker well 2.

It will have been noticed that the side of the lower part of the clinker well 2 facing the tilting part 12 is slightly inclined to the vertical so that it diverges from the tilting part in the downward direction. This is to reduce the quantity of ash that can fall behind the scraper blade 14.

The jam having been cleared, the ram 16 is retracted to juxtapose the tilting part 12 to the fixed part 11 along the sealing dihedron 18, 18'; the ram of the locking means 18*c* is extended so that the hooks are engaged under the projecting members and the normal water level 10*a* is re-established. The ram-actuated plunger 21 is retracted to release the scraper blade 14. The hearth is gradually returned to normal conditions by returning the flap 1*a* to a suitable angle, reciprocating the mobile bars at the normal rate and re-establishing normal draft and draw-off conditions.

If very long incombustible objects such as metal bed frames, for example, are placed on the grate they may become oriented lengthways and so drop through the clinker well 2 and jam slantwise in the chamber 3. This may prevent the chamber being opened at all or enough to clear the jam.

It is then necessary to open the hatch 12*a* after draining the chamber to attempt to extract the jammed object, possibly by cutting it up using a thermal lance. Hence the benefit of providing an inspection hatch 12*a* of sufficient size for work of this nature.

Figure 4:
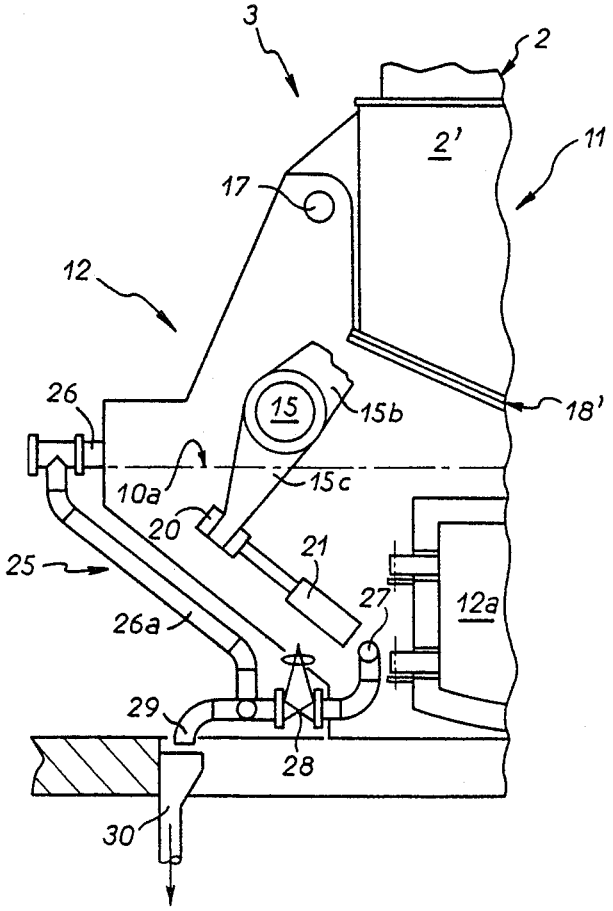
FIG. 4 shows the water off take pipes of the ashbox in accordance with the invention omitted from FIGS. 1 through 3 for reasons of clarity.

There will be now described with reference to FIG. 4 how the water level 10*a* in the chamber 3 is maintained constant in normal operation and can be reduced to practically nothing before opening the chamber.

This figure shows in a schematic way the posterior portion of the tilting part 12 of the chamber 3 with the pivot axis 17, the finger 15*c* that can be locked between the abutment 20 and the ram-actuated plunger 21 and the inspection hatch 12*a*.

The water is supplied conventionally to the chamber 3 by means of pipes and valves which can shut off the water feed entirely or fill the chamber at a high flowrate if the actual level of water in the chamber is substantially lower than the required level 10*a* or maintain a preset top-up flowrate when the actual level is near the level 10*a;* it is desirable to minimize the quantity of water which escapes through the overflows.

The tilting part 12 is equipped with water take-off pipes 25 which comprise in a vertical posterior wall of this tilting part overflow holes 26 at the required water level 10*a* in the chamber 3 and drain holes 27 situated in the lower part of the chamber 3 between the inspection hatch 12*a* and the end of the ram-actuated plunger 21. The overflow holes 26 are connected to a flow nozzle 29 situated at the lowest point (when the chamber is closed) by a pipe 26*a*. The drain hole 27 is connected to the flow nozzle 29 through a valve 28 which is remote-controlled. When the chamber 3 is closed the flow nozzle 29 is immediately above a drain trough 30.

It will be noted that it is important that the overflow holes 26 and especially the drain hole 27 are in portions of the tilting part 12 where there is little risk of ash accumulating. Nevertheless, these holes are provided with inspection plugs for clearing any clogging.

It will be understood that all jam clearing operations in the event of a jam with no aggravating circumstances such as the jamming of a long object can be performed remotely and therefore under centralized control, virtually without intervention by personnel on the ashbox. It should be possible to clear a jam by damping down the hearth for less than a hour whereas clearing jams in prior art chambers often entails damping down for several hours or more.

Of course, the invention is not limited to the examples described but encompasses all variant executions thereof.

In particular, the use of hook and ram type locking means is not the only way to clamp the sealing gasket between flanges on the fixed and tilting parts.

I claim:

1. Ashbox for the hearth of a furnace adapted to burn solid fuel, especially urban waste, discharged onto an upper end of an inclined grate and descending along said grate as it burns to a lower end of said grate, the ashbox comprising an extractor chamber having an upper edge and a concave bottom which is part-cylindrical with horizontal generatrices, said chamber being adapted to be filled with water to a normal level below that of said upper edg, a vertical clinker well under the lower end of said grate, terminating at a lower lip below said upper edge of said chamber and adapted to be immersed in the water in said chamber when filled to said normal level, a scraper blade adapted to bear on said concave bottom of said chamber along a generatrix thereof, means for reciprocating said scraper blade perpendicularly to the generatrices of said concave bottom of said chamber, an inclined wall merging at its lower end with said concave bottom of said chamber along a generatrix thereof, and an overflow lip at the upper end of said inclined wall above the normal level of the water in said chamber, the arrangement being such that reciprocation of said scraper blade pushes ash up said inclined wall and over the overflow lip, into recovery means, in which ashbox said extractor chamber is in two parts and can be opened by relative displacement thereof to provide vertical access to said ash well, one part of said chamber being a fixed part comprising said inclined wall and said upper edge of said chamber and the other part being a tilting part comprising said concave bottom and said scraper blade and adapted to pivot relative to said fixed part about an axis parallel to said generatrices of said concave bottom between an open position and a closed position in which it is sealed to said fixed part on a sealing surface.

2. Ashbox according to claim 1 wherein said sealing surface is a dihedron comprising two half-planes intersecting at an edge parallel to said generatrices of said concave bottom, substantially coincident with said normal level of the water in said chamber and on the side of said clinker well nearest said inclined wall.

3. Ashbox according to claim 2 wherein one of said half-planes of said dihedron is directed downwards substantially perpendicularly to said inclined wall so as to pass substantially through the generatrix of said curved bottom where the latter merges with said inclined wall and the other half-plane of said dihedron rises from said edge to said upper edge of said chamber which it intersects on the side of said clinker well farthest from said inclined wall.

4. Ashbox according to claim 2 wherein said fixed and tilting parts of said chamber comprise respective flanges in said half-planes of said dihedron and further comprising a sealing gasket adapted to lie between said flanges when said chamber is closed and locking means adapted to fasten said tilting part to said fixed part with said gasket clamped between them.

5. Ashbox according to claim 4 wherein said locking means incorporate hydraulic rams.

6. Ashbox according to claim 1 wherein the pivot axis about which said tilting part pivots relative to said fixed part is above said upper edge of said chamber on the side of said clinker well farthest from said inclined wall.

7. Ashbox according to claim 1 further comprising a scraper shaft above said normal water level, parallel to the generatrices of said concave bottom and on the side of said well farthest from said inclined wall, cranks keyed to said scraper shaft, thrust arms coupled to said cranks and carrying said scraper blades at their ends, at least one substantially horizontal hydraulic ram adapted to rotate said scraper shaft to-and-fro disposed outside said chamber and pivoted at one end to said fixed part of said chamber, a control crank keyed to said scraper shaft, and a crank pin on said control crank coupled to the other end of said at least one substantially horizontal ram, the offset between said cranks and said control crank being such that when said at least one substantially horizontal ram is retracted said scraper blade is farthest from said inclined wall.

8. Ashbox according to claim 7 wherein the pivot axis about which said tilting part pivots relative to said fixed part is above said upper edge of said chamber on the side of said clinker well farthest from said inclined wall and said crank pin on said control crank moves along a path which passes between the axis of said scraper shaft and the pivot axis of said tilting part of said chamber and further comprising locking means between said scraper shaft an said tilting part of said chamber adapted when activated to prevent rotation of said scraper shaft with said scraper blade at its position farthest from the generatrix of said concave bottom at which the latter merges with said inclined wall.

9. Ashbox according to claim 8 wherein said locking means comprise a radial finger on said scraper shaft outside said chamber, an abutment on said tilting part of said chamber against which said finger bears when said scraper blade is at its position farthest from the generatrix of said concave bottom at which the latter merges with said inclined wall and a ram-actuated plunger directed towards said abutment and adapted when in an extended position which corresponds to the activated state of said locking means to press said finger onto said abutment and when in a retracted position to be away from the path of movement of said finger.

10. Ashbox according to claim 1 further comprising above said clinker well and at the downstream end of said grate a flap pivoted to rotate about an axis transverse to said grate and adapted to be adjusted in angular position in order to vary the level of its end relative to the plane of said grate.

11. Ashbox according to claim 1 further comprising a fixed drain channel, water off take pipes leading to said drain channel from said tilting part of said chamber, at least one overflow hole at said normal water level in said chamber, at least one drain hole in the lower part of said chamber, a (respective) valve on said drain hole(s) and at least one flow nozzle at the lower ends of said water off take pipes disposed over said drain channel when said tilting part of said chamber is in the closed position.

12. Ashbox according to claim 11 wherein said valve(s) associated with said at least one drain hole is or are adapted to be remote-controlled.

* * * * *